United States Patent [19]

Guild et al.

[11] 4,430,024

[45] Feb. 7, 1984

[54] HYDRAULICALLY OPERATED MANDRELS

[75] Inventors: Charles L. Guild; Nicholas H. Werthessen, both of Barrington; Carlton W. Aldrich, Jr., Cranston, all of R.I.

[73] Assignee: American Pile Driving Corporation, East Providence, R.I.

[21] Appl. No.: 290,414

[22] Filed: Aug. 5, 1981

[51] Int. Cl.[3] ..... E02D 11/00

[52] U.S. Cl. ..... 405/232; 405/247; 269/48.1

[58] Field of Search ..... 405/232, 243, 245, 246, 405/247; 173/131, 132; 269/48.1

[56] References Cited

U.S. PATENT DOCUMENTS

| | | | |
|---|---|---|---|
| 2,881,593 | 4/1959 | Cobi | 405/247 |
| 3,118,284 | 1/1964 | Cobi | 405/247 |
| 3,131,544 | 5/1964 | Thornley | 405/247 |
| 3,803,854 | 4/1974 | Guild et al. | 405/247 |
| 3,984,992 | 10/1976 | Merjan | 405/247 |

*Primary Examiner*—Dennis L. Taylor
*Assistant Examiner*—John A. Gungor

[57] ABSTRACT

Expandable tubular mandrels have lengthwise sections the upper ends of which are joined by a head. Hydraulically operated piston-cylinder units within the mandrel are spaced apart lengthwise of the sections and connected to the mandrel in a manner such that the axis of each unit extends lengthwise of the mandrel and expanding and contracting forces are applied to the mandrel sections when the units are operated to vary their overall length, to effect mandrel expansion when their overall lengths are changed in one direction and mandrel retraction when changed in the opposite direction.

14 Claims, 11 Drawing Figures

10
42
45
40
47
41
39A
46
39
37
52B
31
52A
36
35
36A
53A
53B
36B
38
44
43

HYDRAULICALLY OPERATED MANDRELS

BACKGROUND REFERENCES

U.S. Pat. No. 3,118,284
U.S. Pat. No. 3,131,544
U.S. Pat. No. 3,803,854
U.S. Pat. No. 3,984,992

BACKGROUND OF THE INVENTION

Expandable mandrels of the type having lengthwise sections joined at their upper ends by a head and provided with means by which the sections below the head are moved between a retracted relationship in which the mandrel may be entered into a tubular pile, which may be a corrugated shell or a thin walled pipe, and then so expanded that the sections grip the pile, are widely used to drive such piles.

Where the means for moving the mandrel sections between their pile-entering and their pile gripping relationships include a hydraulically operated, piston-cylinder unit having cables reeved about sheaves utilized in a manner such that the actuation of the unit effected at least the expanded relationship of the sections and desirably their retracted relationship as well, extremely effective operation is ensured as the hydraulic pressure can be varied to meet driving conditions and the force exerted on the mandrel sections so well distributed that pile distortion or slippage is avoided.

Such a mandrel, with various ways to utilize the sheaves to exert such forces, is illustrated by U.S. Pat. No. 3,803,854 which, in addition to showing the mounting of the sheaves on the mandrel sections in a manner such that the cable or cables are so sinuously held thereby that a straightening pull applies the wanted force through the sheaves to the mandrel sections, also discloses the use of the sheaves to actuate toggle joints by which the wanted forces are applied.

As above stated, such hydraulically operated expansible mandrels are highly effective in driving and withdrawing tubular piles although the mounting of the sheaves and the reeving of the cable imposes some limitations on their construction and use and limits the retraction force.

We are aware that one type of expandable mandrels utilized cam or wedge means carried by a rod extending lengthwise of and between the mandrel sections to force them into their pile gripping relationship with that type illustrated by the previously referred to patents; U.S. Pat. Nos. 3,118,284 and 3,131,544, and also that expansible mandrels have beem made with their sections interconnected by a series of transversely disposed, hydraulically operated, piston-cylinder units, see U.S. Pat. No. 3,984,992.

THE PRESENT INVENTION

The general objective of the present invention is to provide improved means by which the expansion and retraction of the mandrel sections can be effected hydraulically.

In accordance with the invention, this objective is attained with a series of piston-cylinder units within a mandrel with their axes extending lengthwise thereof and with the units spaced apart in a wanted relationship. The units are incorporated in the mandrel in a manner such that expanding and retracting forces are applied to the mandrel sections when the units are operated with expanding force exerted when a unit or units are operated to change their overall lengths in one direction and with retracting force exerted when a unit or units are operated to change their overall lengths in the opposite direction. While one or more units may apply expanding force and another unit or units apply retracting force, it is preferred that each unit apply both forces.

While a unit may be attached to one mandrel section with either its cylinder or its rod movable lengthwise of the mandrel from a first position and provided with a connection with both sections operable to exert the wanted force or forces, it is an important feature of the invention that both the piston rod and the cylinder of preferably all of the units be so connected that both may move lengthwise of the mandrel relative to first positions and in opposite directions, preferably with both connections applying both forces.

In one embodiment of the invention, the connecting means operable to exert expanding and retracting forces are toggle joints with the outer end of each link pivotally mounted in the appropriate one of the mandrel sections to apply expanding and retracting forces thereto and the inner ends of the links pivotally connected to the piston rod of each unit, the cylinder thereof or, as is preferred, both connecting means of each unit are thus connected toggle joints and are oppositely disposed so that as the overall length of the units is varied, both joints have the same function.

Another objective is to enable the toggle joints to be readily incorporated in the mandrels, an objective attained with each mandrel section having a central, lengthwise channel or trough within each of which a pair of support blocks are positioned to bear against the interior surface of that mandrel section. Each pair of support blocks carries a pivot to which the outer link end or ends are connected. Each support block is held by upper and lower cleats against moving lengthwise of the associated channel and is held seated by one of them.

In another embodiment of the invention each connection between a unit and the mandrel sections has blocks secured to the sections between which a shoe is positioned with the shoe fixed on the free end of the piston rod, the opposite end of the cylinder or both the rod and the cylinder may be provided with such a connection as is preferred. The shoes and blocks have coacting cam surfaces by which expanding forces are exerted on the mandrel sections when the units are operated to effect that result and, preferably, the shoes and blocks of both connections are also provided with coacting cam surfaces operable to exert retracting force on the mandrel sections when the units are operated in the retracting mode. The cam surfaces of the blocks and shoes of the two connections are oppositely disposed.

With mandrel sections having central channels extending lengthwise of their interiors, each such connection includes a pair of blocks for each channel which are secured to the proximate surface thereof with a shoe between them. The proximate faces of each pair of cam blocks have identical channels or grooves providing the cam surfaces and each shoe has shoulders or wings, one for each such groove and entrant thereof and providing cam surfaces to coact with those of the blocks.

It will be appreciated that depending on the disposition of the toggle joints or the cam surfaces, expanding forces may result when the overall lengths of the unit is shortened and retracting force applied when the overall lengths are increased or the expanding forces result from an increase in length of the units and the retracting force a result of the overall length of the units being decreased.

In embodiments of the invention where both the piston rods and the cylinders move lengthwise in opposite directions as the units are expanded and contracted, the conduits for the pressurized hydraulic fluid are accommodative of such movements at least with reference to their connection with the upper end of the mandrel and preferably the conduits are flexible except where connected to the cylinders.

Other objectives of the invention and its novel features and advantages will be apparent from the following description of the drawings and the appended claims.

BRIEF DESCRIPTION OF THE DRAWINGS

The accompanying drawings illustrate preferred embodiments of the invention of which

THE PREFERRED EMBODIMENT OF THE INVENTION

Figure 1:
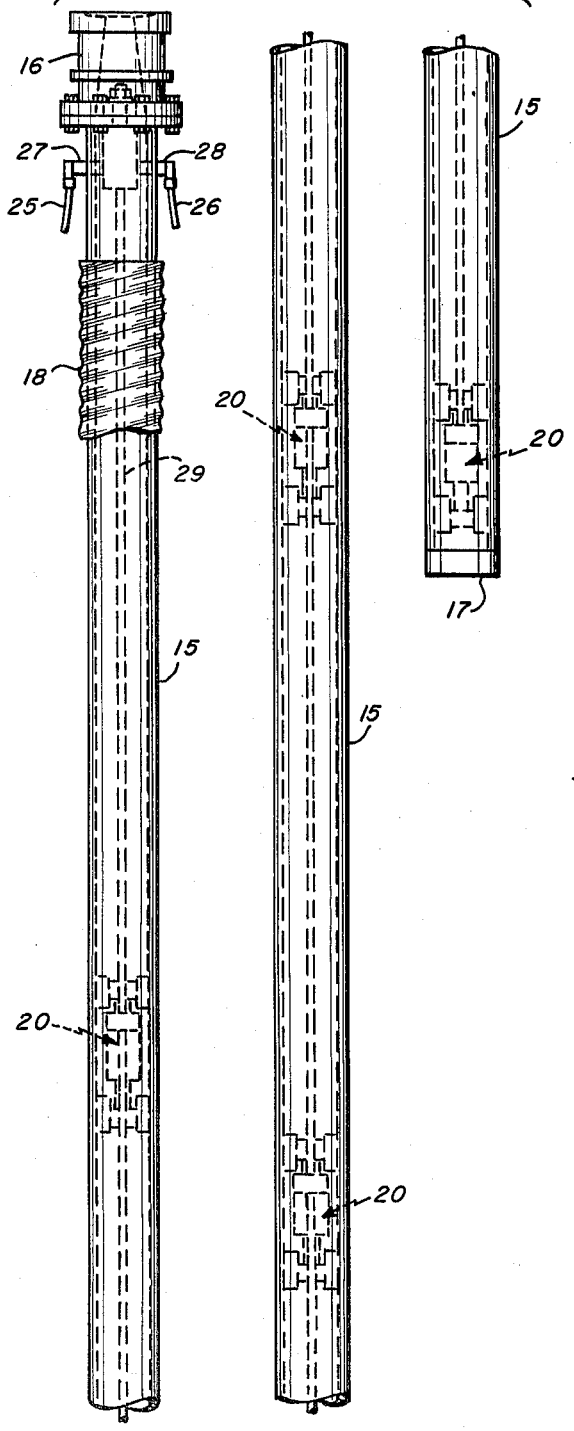
FIG. 1 is a somewhat schematic view of a mandrel in accordance with one embodiment of the invention within a typical tubular pile which is partly broken away to expose the mandrel sections which are shown as sectioned lengthwise.
Figure 2:
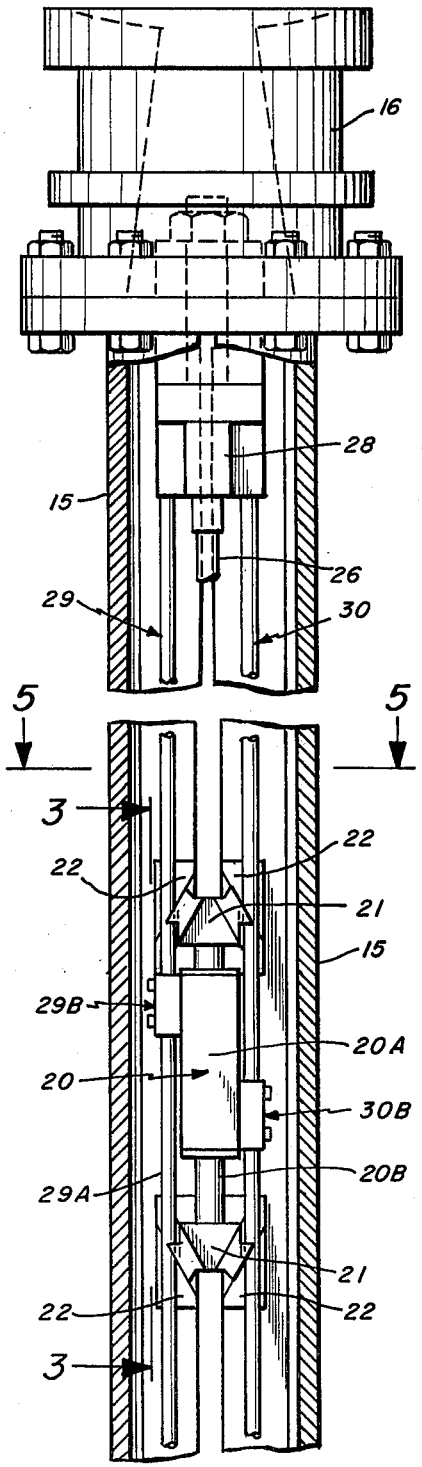
FIG. 2 is a fragmentary and partly sectioned view of the head end of the mandrel on a substantial increase in scale and with the mandrel turned 90° from its FIG. 1 position and expanded.
Figure 3:
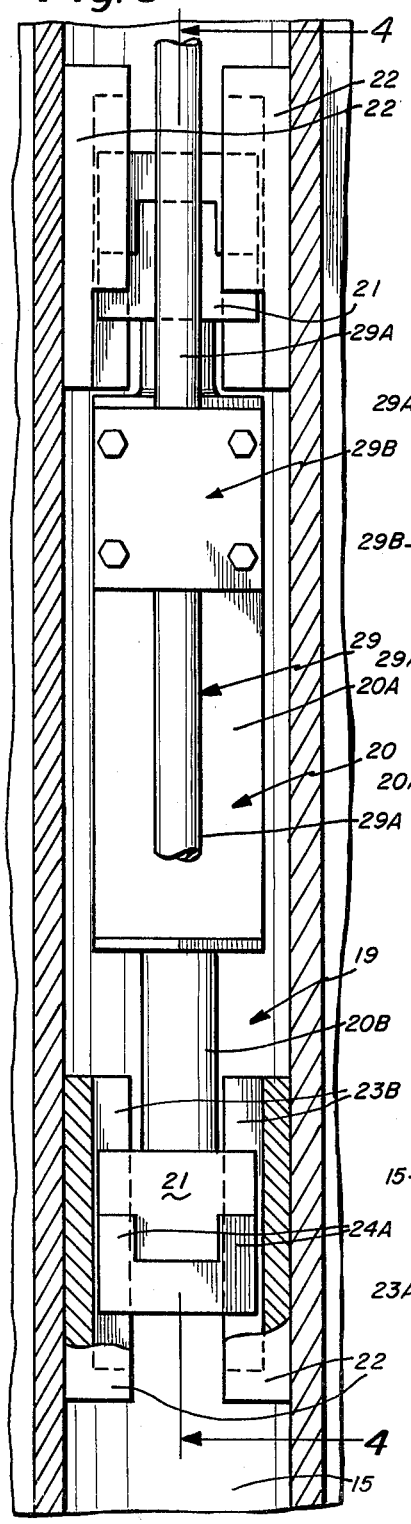
FIG. 3 is a fragmentary section, on a further increase in scale, taken approximately along the indicated line 3—3 of FIG. 2, the mandrel being shown as expanded.

In the embodiment of the invention illustrated by FIGS. 1-6, an expansible mandrel is shown as having identical lengthwise sections 15, joined at their upper ends by a head 16 with boot parts 17 secured to their lower ends. The sections 15 are shaped and dimensioned to have a first or inoperative relationship in which they may be entered into a tubular pile 18, such as one of the corrugated type a part as shown in FIG. 1, and an expanded, spaced apart relationship in which the sections so grip the interior of the pile as to enable the pile to be driven or a driven pile to be withdrawn. Each mandrel section 15 has reinforcements providing a lengthwise channel or trough, generally indicated at 19.

The hydraulically operated means by which the mandrel sections 15 are moved between their expanded and retracted relationships utilizes piston-cylinder units which are generally indicated at 20 and which are disposed with their axes extending lengthwise of the mandrel. The upper end of the cylinder 20A of each unit 20 and the end of the piston rod 20B are each provided with an expansion shoe 21 each of which is the mirror image of the other.

Two pairs of identical, oppositely disposed cam blocks 22 are provided for each shoe 21 of each unit 20 with one block of each pair welded to the appropriate one of the side walls of the channel 19 of each mandrel section with the appropriate one of the shoes 21 between both pairs.

Figure 6:
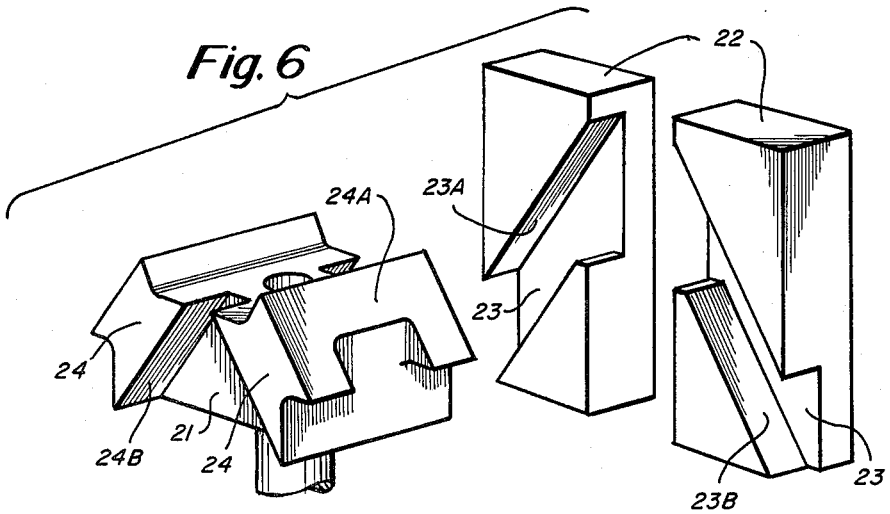
FIG. 6 is a perspective, exploded view, showing one shoe and one of the two pairs of associated cam blocks.
Figure 7:
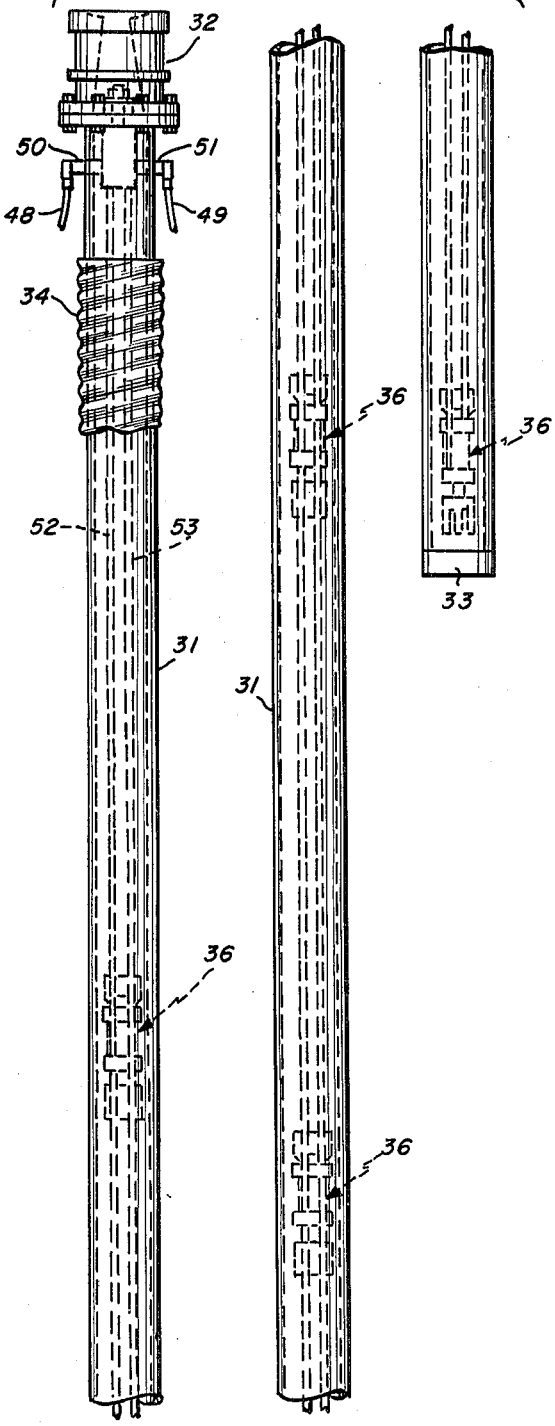
FIG. 7 is a schematic view, similar to FIG. 1, illustrating another embodiment of the invention.
Figure 8:
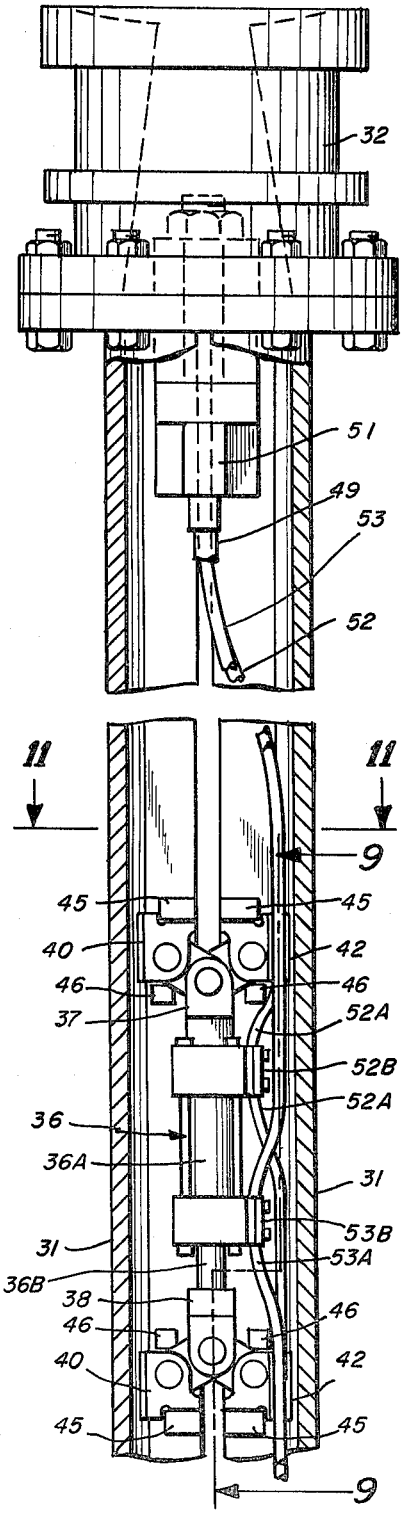
FIG. 8 is a fragmentary and partly sectioned view, on a substantial increase in scale, of the head end of the mandrel of FIG. 7 with the mandrel turned 90° from its FIG. 7 position and expanded.
Figures 9, 10:
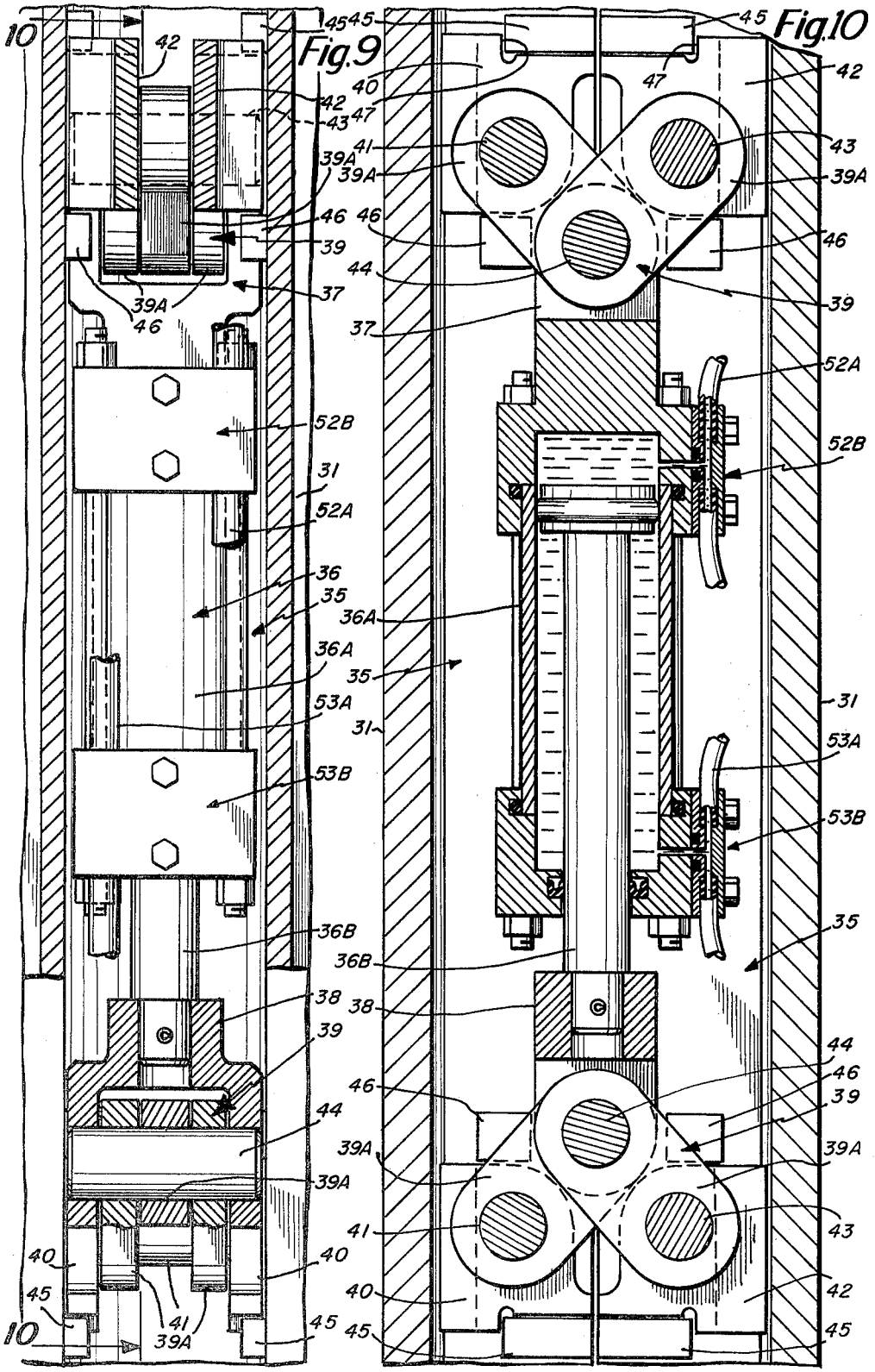
FIG. 9 is a section taken approximately along the indicated line 9—9 of FIG. 8.
FIG. 10 is a section taken approximately along the indicated line 10—10 of FIG. 9 but with the mandrel retracted.
Figure 11:
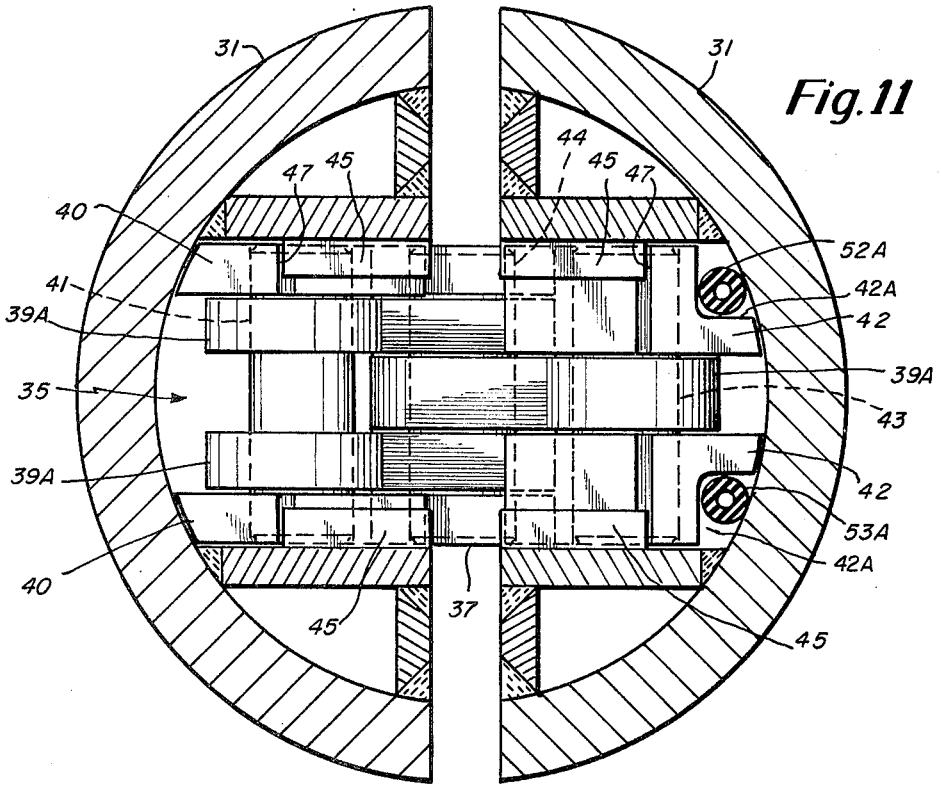
FIG. 11 is a section taken approximately along the indicated line 11—11 of FIG. 8.

The cam blocks 22 of each pair have, see FIG. 6, a groove or channel 23 in their proximate faces with the grooves inclined towards but away from the associated unit 20 and provide parallel cam surfaces 23A and 23B. Each shoe 21 has laterally disposed, angled wings or shoulders 24, each shaped and dimensioned to fit in a channel 23 and provide parallel cam surfaces 24A and 24B in engagement with the cam surfaces 23A and 23B, respectively, of the cam blocks 22 and serve both to interconnect the mandrel sections and to enable them to be forced apart and forcibly retracted as the overall length of the units is increased or decreased.

Hydraulic fluid under wanted pressure from a pump controlled source, not shown, is delivered through conventional, valve controlled conduits 25 and 26 to the mandrel the head 16 of which supports junctions 27 and 28 within the mandrel with each junction having an exposed fitting enabling the conduit 25 to be connected to the junction 27 and the conduit 26 connected to the junction 28.

A conduit, generally indicated at 29, from the junction 27 extends lengthwise of one mandrel section 15 and includes sections 29A of flexible tubing. The proximate ends of the sections 29A are clamped in connectors 29B, one for each cylinder 20A and bolted and suitably sealed to the upper end thereof with the proximate ends of the sections 29A placed thereby in communication with each other and the interior of that cylinder, see FIG. 4. Similarly, a conduit generally indicated at 30, from the junction 28 extends lengthwise of the other mandrel section 15 and includes sections 30A of flexible tubing the proximate ends of which are similarly placed in communication with each other and the interiors of the cylinders 20A by similar connectors 30B, one for each cylinder 20A and secured to the lower end thereof.

Figure 4:
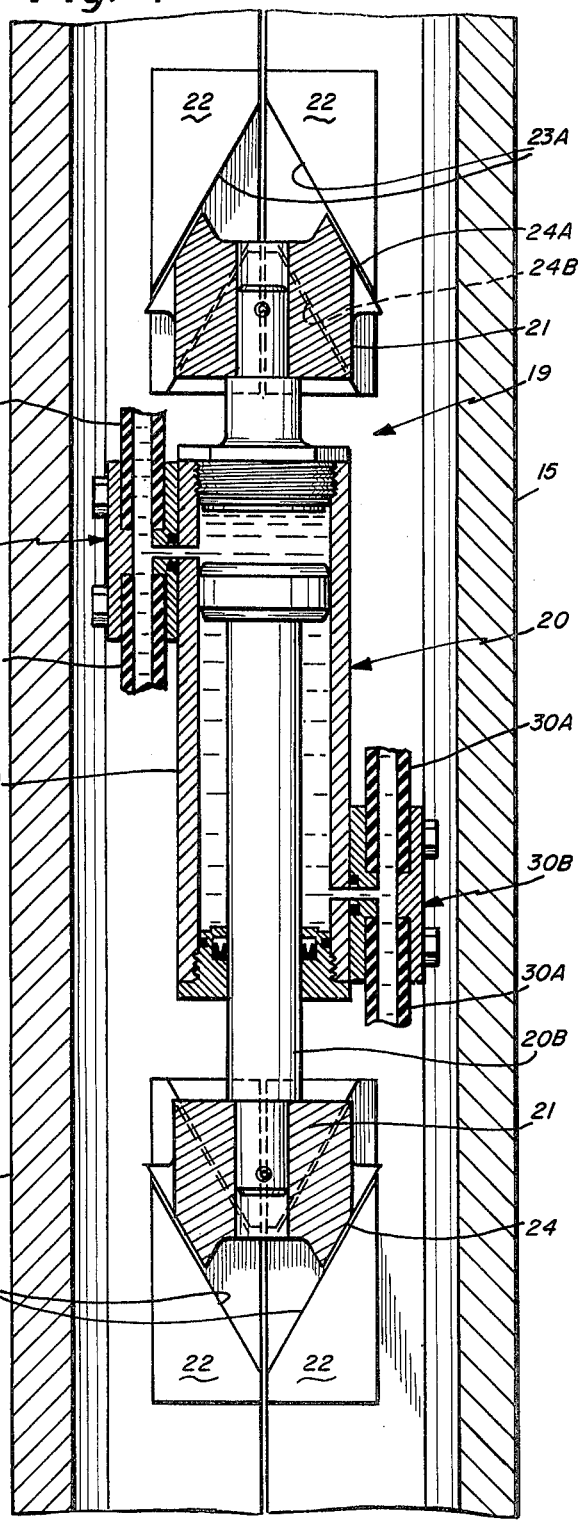
FIG. 4 is a section taken approximately along the indicated line 4—4 of FIG. 3, the mandrel being shown as retracted.
Figure 5:
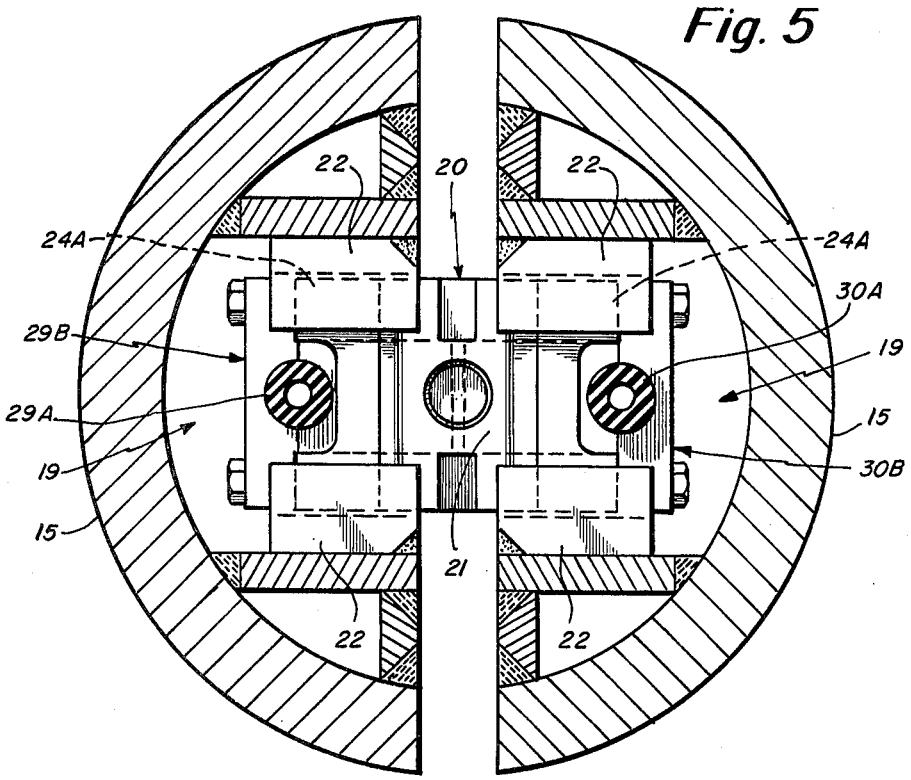
FIG. 5 is a section taken approximately along the indicated line 5—5 of FIG. 2.

When the mandrel sections are fully retracted, see FIG. 4, the overall length of each unit is at a minimum with the cylinders 20A in first positions, both first positions relative to the mandrel sections. It will be appreciated that the flexible sections of the conduits 29 and 30 are of lengths providing some slack to enable the cylinders 20A to move upwardly lengthwise of the mandrel from their first positions without strain on the conduits.

When pressurized hydraulic fluid is delivered through the conduit 29 to and returned from the cylinders 20A via the conduit 30, each unit is extended with the cylinders and piston rods both moving in opposite directions from their first positions and both shoes 21 forcing their engaged block to effect mandrel expansion. Similarly, when pressurized hydraulic fluid is delivered to each cylinder 20B through the conduit 30 and returned therefrom via the conduit 29, the overall length of the units 20 is decreased with the first positions of the cylinders and piston rods reestablished and the mandrel sections retracted with adequate force.

The embodiment of the invention illustrated by FIGS. 7–11 is shown as utilizing a mandrel construction similar to that just described with mandrel sections 31 joined at their upper end by a head 32 and with their lower ends provided with boot portions 33. The mandrel sections 31 are movable between retracted positions in which they may be entered in a tubular pile, a section of one of the corrugated type indicated at 34 in FIG. 7, and expanded positions or relationships and they are so shaped and dimensioned that in their expanded relationship they are in tight driving engagement with the interior of the pile. Lengthwise reinforcements in each mandrel section provide a channel or trough generally indicated at 35.

The mandrel sections are expanded into their operative, pile-gripping relationship and retracted into their inoperative relationship hydraulically. The means for so doing include a series of piston-cylinder units generally indicated at 35 spaced apart lengthwise of the mandrel in a desired manner, ten feet by way of example and not of limitation with their axes extending lengthwise of the mandrel. The cylinder 36A of each unit 36 has a clevis 37 fixed on its upper end and a clevis 38 is fixed on the exposed end of the piston rod 36B.

Each unit 36 is located between upper and lower, identical, but oppositely disposed toggle joints generally indicated at 39 with each including a pair of support blocks 40 for one mandrel section with the blocks of each pair the mirror image of the other in order that each may seat against the interior of said one section within the channel 35 thereof. The outer ends of a pair of links 39A are mounted on a pivot 41 carried by each pair of blocks 40. A pair of support blocks 42 for the other mandrel section 31 are the mirror image of each other in order to seat against the interior of that section within the channel 35 thereof. The support blocks 42 are thicker than the blocks 40 in order to so position a single link 39A, which is supported by a pivot 43 carried by the blocks 40, to be positioned between the pair of links 39A when the three links are connected to the appropriate one of the clevises 37, 38 by a pivot 44.

Each block 40, 42 is not connected to the mandrel section against which it is seated but is confined within the channel of that section between cleats 45 and 46 spaced apart lengthwise of the mandrel and anchored to the proximate faces of the channels 35 with the cleats 45 between the cleats 46 and the appropriate one of the piston-cylinder units 36. Each block has a shoulder 47 engaged by a cleat 45 thereby to be held seated.

A pump controlled source, not shown, of hydraulic fluid under a wanted pressure has two conduits 48 and 49 which are conventionally valve controlled so that each can be used to deliver pressurized fluid from the pump or to return such fluid to a reservoir. The conduits 48 and 49 are connected to junctions 50 and 51, respectively, which are carried by the mandrel head 32 with fittings exposed between the upper ends of the sections 31.

A conduit, generally indicated at 52, is connected to the junction 50 and extends downwardly between the sections 31 and includes sections 52A of flexible tubing with the proximate ends of the sections 52A clamped in connectors 52B, one for each unit 36 and bolted and sealed to the upper end of the cylinder 36A thereof with the proximate ends of the sections 52A placed thereby in communication with each other and the interior of the cylinders 36A. Similarly, a conduit, generally indicated at 53 extends downwardly between the sections 31 and includes sections 53A of flexible tubing the proximate ends of which are similarly placed in communication with each other and the interior of the cylinders 36 by similar connectors 53B, one for each cylinder and bolted and sealed to the lower end thereof. It will be noted that the support blocks 42 have their outer ends marginally recessed at 42A, see FIG. 11, so that each may accommodate the appropriate one of the flexible conduit sections 52A, 53A.

When the mandrel sections are retracted, the overall length of each piston-cylinder unit is at a minimum, and each cylinder 36A and each piston rod 36B is supported in a first position relative to the mandrel sections. Because of the flexible conduit sections 52A and 53A the cylinders and rods are both allowed to move longitudinally relative to the mandrel sections as required.

When pressurized hydraulic fluid is delivered to the cylinders 36A through flexible conduit 52, the overall length of the units 36 is increased. Because of the flexible conduit sections 52A and 53A, the cylinders as well as the pistons move with their movements in opposite directions whereby both the upper and lower toggle joints 39 are moved equally to exert expanding force on the mandrel sections.

When pressurized fluid is delivered to the cylinders 36A through the conduit 52 to effect the retracted relationship of the mandrel sections, both the cylinders and the piston rods are returned to their first positions with the retraction force adequate to ensure the return of the sections 31 to their pile-entering relationship under all conditions.

We claim:

1. An expandable tubular mandrel for use in driving or withdrawing tubular piles, said mandrel including a pair of lengthwise sections, a head connected to and joining the upper ends of said sections, said sections below said head movable between retracted, pile-entering and expanded pile-gripping relationships, and hydraulically operated means to effect said relationships, said means including a series of piston-cylinder units spaced lengthwise of the mandrel and means incorporating said units therein with their axes extending lengthwise thereof in a manner such that expanding and contracting forces are applied to the sections when the units are operated to vary their overall lengths, to effect mandrel expansion when the overall length of at least one unit is changed in one direction and mandrel contraction when the overall length of at least one unit is changed in the opposite direction, means operable to deliver pressurized hydraulic fluid to and from said units to thus effect their operation, and said incorporating means includes connecting means for each unit, one for the cylinder and one for the piston rod thereof, one connecting means connected to at least one mandrel section and the other to both of said sections and operable to exert at least one of said forces thereon with the overall lengths of the units changed in one and the same direction.

2. The expandable mandrel of claim 1 in which said other connecting means is operable to exert both of said forces.

3. The expandable mandrel of claim 1 in which said one connecting means is also connected to both sections and is operable to exert at least one of said forces with the overall lengths of the units changed in opposite directions.

4. The expandable mandrel of claim 3 in which said one connecting means is operable to exert both of said forces.

5. The expandable mandrel of claim 1 in which the change in overall lengths of the units is attended by lengthwise movements of the cylinders thereof and the means operable to deliver pressurized hydraulic fluid to the units include conduits extending lengthwise of the interior of the mandrel, one in communication with one end of each cylinder and one in communication with the other ends thereof, said conduits including sections accommodative of such movements of the cylinders.

6. The expandable mandrel of claim 4 in which each conduit includes a connection with the appropriate end of each cylinder and each conduit includes a fexible section between each two corresponding ends of adjacent cylinders and of a length such that adjacent cylinders may move relative to each other.

7. The expandable mandrel of claim 1 in which the connecting means operable to effect mandrel expansion and contraction are toggle joints.

8. The expandable mandrel of claim 4 in which the connecting means operable to effect mandrel expansion and contraction are toggle joints, the toggle joints connected to the cylinders disposed oppositely to those connected to the piston rods.

9. The expandable mandrel of claim 7 in which the mandrel sections have centrally located channels extending lengthwise of their interiors, and each toggle joint includes first means pivotally connected to the remote ends thereof and second means connecting each of said first means to the appropriate one of said channels.

10. The expandable mandrel of claim 9 in which the second means are pairs of cleats, the cleats of each pair spaced apart lengthwise of the mandrel and holding the appropriate one of the first means against movement lengthwise of the mandrel and one cleat of each pair holding the associated first means against movement towards the opposite channel.

11. The expandable mandrel of claim 10 in which the first means are pairs of blocks shaped and dimensioned to fit in the channels and against the interior surface of the mandrel sections, and the remote ends of the toggle joint links are between the blocks and pivotally connected thereto.

12. The expandable mandrel of claim 1 in which the connecting means operable to effect mandrel expansion and contraction includes a shoe movable with the unit lengthwise of the mandrel when the length thereof is varied and blocks carried by the sections, said shoe and blocks having coacting cam surfaces operatively engaged during changes in the overall length of the unit in both mandrel expanding and mandrel retracting directions.

13. The expandable mandrel of claim 4 in which the connecting means operable to effect mandrel expansion and contraction include shoes, one connected to the cylinder and one connected to the piston of said unit, and sets of blocks carried by the section, one set for each shoe, said block and shoes having coacting cam surfaces, the cam surfaces of the shoe carried by the rods and of the associated blocks disposed opposite to the cam surfaces of the shoe carried by the cylinders and the associated blocks, all of said cam surfaces operatively engaged during changes in the overall length of the units in both mandrel expanding and mandrel retracting directions.

14. The expandable mandrel of claim 12 in which the mandrel sections have centrally located channels extending lengthwise of their interior surfaces, each set of blocks consist of two blocks, one for each of the proximate surfaces of the channels and welded thereto, the proximate faces of the two blocks each having a transverse channel establishing parallel cam surfaces, and each shoe fits between the two blocks and has wings, one for each block and shaped and dimensioned to be a sliding fit therein.

* * * * *